US011752590B2

(12) United States Patent
Kato et al.

(10) Patent No.: US 11,752,590 B2
(45) Date of Patent: Sep. 12, 2023

(54) POLISHING HEAD AND POLISHING APPARATUS

(71) Applicant: EBARA CORPORATION, Tokyo (JP)

(72) Inventors: Yuichi Kato, Tokyo (JP); Osamu Nabeya, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 0 days.

(21) Appl. No.: 17/511,944

(22) Filed: Oct. 27, 2021

(65) Prior Publication Data

US 2022/0134506 A1 May 5, 2022

(30) Foreign Application Priority Data

Nov. 4, 2020 (JP) ..... 2020-184268

(51) Int. Cl.
*B24B 37/20* (2012.01)
*B24B 37/30* (2012.01)

(52) U.S. Cl.
CPC ..... *B24B 37/20* (2013.01); *B24B 37/30* (2013.01)

(58) Field of Classification Search
CPC ..... B24B 37/30–32
See application file for complete search history.

(56) References Cited

U.S. PATENT DOCUMENTS

| | | | | |
|---|---|---|---|---|
| 6,923,714 | B1 * | 8/2005 | Zuniga | B24B 37/30 451/388 |
| 7,635,292 | B2 * | 12/2009 | Togawa | B24B 37/30 451/288 |
| 8,454,413 | B2 * | 6/2013 | Oh | B29C 35/02 451/398 |
| 9,662,764 | B2 * | 5/2017 | Fukushima | B24B 37/042 |
| 10,442,056 | B2 * | 10/2019 | Namiki | B24B 37/30 |
| 2018/0304441 | A1 * | 10/2018 | Chen | B24B 41/067 |
| 2019/0358768 | A1 * | 11/2019 | Kang | B24B 37/32 |
| 2021/0053183 | A1 * | 2/2021 | Zuniga | B24B 37/005 |
| 2022/0111483 | A1 * | 4/2022 | Nagengast | B24B 37/32 |

FOREIGN PATENT DOCUMENTS

| | | |
|---|---|---|
| JP | 2006-128582 A | 5/2006 |
| JP | 2009-131946 A | 6/2009 |

* cited by examiner

*Primary Examiner* — Don M Anderson
*Assistant Examiner* — Jonathan R Zaworski
(74) *Attorney, Agent, or Firm* — BakerHostetler

(57) ABSTRACT

A polishing head capable of preventing contact between both side walls of an elastic membrane when a negative pressure is formed in a pressure chamber formed by the elastic membrane. The polishing head includes: a first elastic membrane configured to press the workpiece against the polishing pad; a retainer ring surrounding the first elastic membrane; a second elastic membrane configured to press the retainer ring against the polishing pad; a carrier to which the first elastic membrane is secured; and an attachment member arranged in a pressure chamber formed by the second elastic membrane and fixing the second elastic membrane to the carrier. The attachment member has a support portion extending toward the retainer ring along a side wall of the second elastic membrane.

10 Claims, 12 Drawing Sheets

POLISHING HEAD AND POLISHING APPARATUS

CROSS REFERENCE TO RELATED APPLICATION

This document claims priority to Japanese Patent Application No. 2020-184268 filed Nov. 4, 2021, the entire contents of which are hereby incorporated by reference.

BACKGROUND

Chemical Mechanical Polishing (CMP) is a technique of polishing a workpiece by rubbing the workpiece against a polishing surface of a polishing pad while supplying a polishing liquid containing abrasive grains, such as silica ($SiO_2$), onto the polishing surface of the polishing pad. As shown in FIG. 9, a polishing apparatus for performing CMP includes a polishing table 501 supporting a polishing pad 500 thereon, a polishing head 505 for holding a workpiece W, and a polishing-liquid nozzle 508 for supplying a polishing liquid onto the polishing pad 500.

Polishing of the workpiece W using such a polishing apparatus is performed as follows. While the polishing table 501 is rotated together with the polishing pad 500, the polishing liquid is supplied onto the polishing pad 500 from the polishing-liquid nozzle 508. The polishing head 505 presses the workpiece W against the polishing pad 500 while rotating the workpiece W. While the workpiece W is in sliding contact with the polishing pad 500 in the presence of the polishing liquid, the surface of the workpiece W is planarized by the combination of a chemical action of the polishing liquid and a mechanical action of the polishing pad 500 and abrasive grains contained in the polishing liquid.

During polishing of the workpiece W, the surface of the workpiece W is in sliding contact with the rotating polishing pad 500, and as a result, a frictional force acts on the workpiece W. Therefore, in order to prevent the workpiece W from slipping out the polishing head 505 during polishing of the workpiece W, the polishing head 505 has a retainer ring 510. This retainer ring 510 is arranged so as to surround the workpiece W. While polishing of the workpiece W is performed, the retainer ring 510 rotates and presses the polishing pad 500 on the outside of the workpiece W.

FIG. 10 is a cross-sectional view showing a part of the polishing head 505 shown in FIG. 9. As shown in FIG. 10, the polishing head 505 has an annular elastic membrane 512 for pressing the retainer ring 510 against the polishing pad 500. A pressure chamber 513 is formed inside the elastic membrane 512. When a pressurized gas (for example, pressurized air) is supplied into the pressure chamber 513, the elastic membrane 512 receives a fluid pressure in the pressure chamber 513 to press the retainer ring 510 against the polishing pad 500. Therefore, during polishing of the workpiece W, the retainer ring 510 can prevent the workpiece W from slipping out the polishing head 505.

The polishing head 505 further has an elastic membrane 514 for pressing the workpiece W against the polishing pad 500. A pressure chamber 515 is formed inside the elastic membrane 514. When a pressurized gas (for example, pressurized air) is supplied into the pressure chamber 515, the elastic membrane 514 that receives the fluid pressure in the pressure chamber 515 presses the workpiece W against the polishing pad 500. Therefore, the workpiece W is rubbed against the polishing pad 500 in the presence of the polishing liquid on the polishing pad 500.

When the polishing of the workpiece W is terminated, the polishing head 505 holding the workpiece W is moved away from the polishing pad 500 as shown in FIG. 11A and moved to a predetermined release position together with the workpiece W. Further, as shown in FIG. 11B, a negative pressure is formed in the pressure chamber 513 to raise the retainer ring 510 relative to the workpiece W. Then, as shown in FIG. 11C, a jet of liquid (for example, pure water) is emitted from a release nozzle 519 toward a contact portion of the elastic membrane 514 and the workpiece W, so that the workpiece W is released from the elastic membrane 514.

However, as shown in FIG. 12, when the negative pressure is formed in the pressure chamber 513, side walls of the elastic membrane 512 may be attracted by the vacuum and come into contact with each other. As a result, the retainer ring 510 cannot be raised to a predetermined position, and the retainer ring 510 obstructs the jet of liquid from the release nozzle 519. In addition, a damage to the elastic membrane 512 may be likely to occur, and a life of the elastic membrane 512 may be shortened.

SUMMARY

Therefore, there is provided a polishing head capable of preventing contact between both side walls of an elastic membrane when a negative pressure is formed in a pressure chamber formed by the elastic membrane. There is further provided a polishing apparatus including such a polishing head.

Embodiments, which will be described below, relate to a polishing head configured to press a workpiece, such as a wafer, a substrate, or a panel, against a polishing pad so as to polish the workpiece, and more particularly to a pressing structure for a retainer ring arranged around the workpiece.

In an embodiment, there is provided a polishing head for pressing a workpiece against a polishing pad to polish the workpiece, comprising: a first elastic membrane configured to press the workpiece against the polishing pad; a retainer ring surrounding the first elastic membrane; a second elastic membrane configured to press the retainer ring against the polishing pad; a carrier to which the first elastic membrane is secured; an attachment member arranged in a pressure chamber formed by the second elastic membrane and fixing the second elastic membrane to the carrier; and a coupling member configured to couple the second elastic membrane to the retainer ring, the second elastic membrane including: a bottom wall coupled to the coupling member; and a side wall coupled to the bottom wall, the attachment member having a support portion extending toward the retainer ring along the side wall.

In an embodiment, the side wall comprises a first side wall and a second side wall separated from each other, the support portion comprises two support portions extending along the first side wall and the second side wall, respectively, the attachment member has a recessed portion located between the two support portions, and the coupling member has a protruding portion which is housed in the recessed portion when the coupling member moves toward the attachment member.

In an embodiment, the bottom wall has a cross-sectional shape curved toward the retainer ring, and at least a part of the support portion is housed in the curved bottom wall when the coupling member moves toward the attachment member.

In an embodiment, the attachment member has a groove extending along the support portion in a circumferential direction of the second elastic membrane.

In an embodiment, the attachment member has through-holes extending through the support portion, and the through-holes are arranged along a circumferential direction of the second elastic membrane.

In an embodiment, at least an outer surface of the support portion has been subjected to a friction reduction treatment.

In an embodiment, there is provided a polishing apparatus comprising: a polishing table configured to support a polishing pad; and the polishing head for pressing the workpiece against the polishing pad to polish the workpiece.

According to the above-described embodiments, the support portion can support the inside of the side wall of the elastic membrane and can therefore prevent side walls of the elastic membrane from coming into contact with each other.

DESCRIPTION OF EMBODIMENTS

Figure 1:
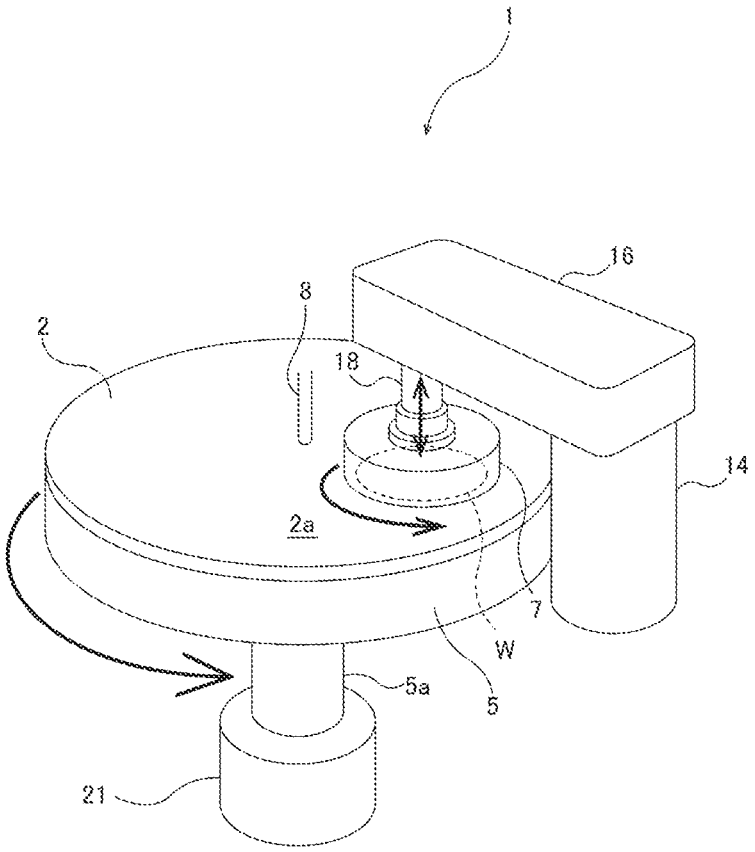
FIG. 1 is a schematic view showing an embodiment of a polishing apparatus.

Hereinafter, embodiments will be described with reference to the drawings. FIG. 1 is a schematic view showing an embodiment of a polishing apparatus. The polishing apparatus 1 is an apparatus configured to chemically and mechanically polish a workpiece W, such as a wafer, a substrate, or a panel. As shown in FIG. 1, this polishing apparatus 1 includes a polishing table 5 that supports a polishing pad 2 having a polishing surface 2*a*, a polishing head 7 configured to press the workpiece W against the polishing surface 2*a*, and a polishing-liquid supply nozzle 8 configured to supply a polishing liquid (for example, slurry containing abrasive grains) to the polishing surface 2*a*. The polishing head 7 is configured to be able to hold the workpiece W on its lower surface.

The polishing apparatus 1 further includes a support shaft 14, a polishing-head swing arm 16 coupled to an upper end of the support shaft 14, and a polishing-head shaft 18 rotatably supported by a free end of the polishing-head swing arm 16. The polishing head 7 is fixed to a lower end of the polishing-head shaft 18. A polishing-head rotating mechanism (not shown) having an electric motor is arranged in the polishing-head swing arm 16. This polishing-head rotating mechanism is coupled to the polishing-head shaft 18, and is configured to rotate the polishing-head shaft 18 and the polishing head 7 in a direction indicated by arrow.

The polishing-head shaft 18 is coupled to a polishing-head elevating mechanism (including a ball screw mechanism and other elements) (not shown). This polishing-head elevating mechanism is configured to move the polishing-head shaft 18 up and down relative to the polishing-head swing arm 16. Such vertical movements of the polishing-head shaft 18 cause the polishing head 7 to move up and down relative to the polishing-head swing arm 16 and the polishing table 5, as indicated by arrows.

The polishing apparatus 1 further includes a table-rotating motor 21 configured to rotate the polishing pad 2 and the polishing table 5 about their central axes. The table-rotating motor 21 is arranged below the polishing table 5, and the polishing table 5 is coupled to the table-rotating motor 21 via a table shaft 5*a*. The polishing table 5 and the polishing pad 2 are rotated about the table shaft 5*a* by the table-rotating motor 21 in a direction indicated by arrow. The polishing pad 2 is attached to an upper surface of the polishing table 5. An exposed surface of the polishing pad 2 constitutes the polishing surface 2*a* for polishing the workpiece W, such as a wafer.

Polishing of the workpiece W is performed as follows. The workpiece W, with its surface to be polished facing downward, is held by the polishing head 7. While the polishing head 7 and the polishing table 5 are rotating independently, the polishing liquid (for example, slurry containing abrasive grains) is supplied onto the polishing surface 2*a* of the polishing pad 2 from the polishing-liquid supply nozzle 8 provided above the polishing table 5. The polishing pad 2 rotates about its central axis together with the polishing table 5. The polishing head 7 is moved to a predetermined height by the polishing-head elevating mechanism (not shown). Further, while the polishing head 7 is maintained at the predetermined height, the polishing head 7 presses the workpiece W against the polishing surface 2*a* of the polishing pad 2. The workpiece W rotates together with the polishing head 7. The workpiece W is rubbed against the polishing surface 2*a* in the presence of the polishing liquid on the polishing surface 2*a* of the polishing pad 2. The surface of the workpiece W is polished by a combination of the chemical action of the polishing liquid and the mechanical action of the polishing pad 2 and the abrasive grains contained in the polishing liquid.

Figure 2:
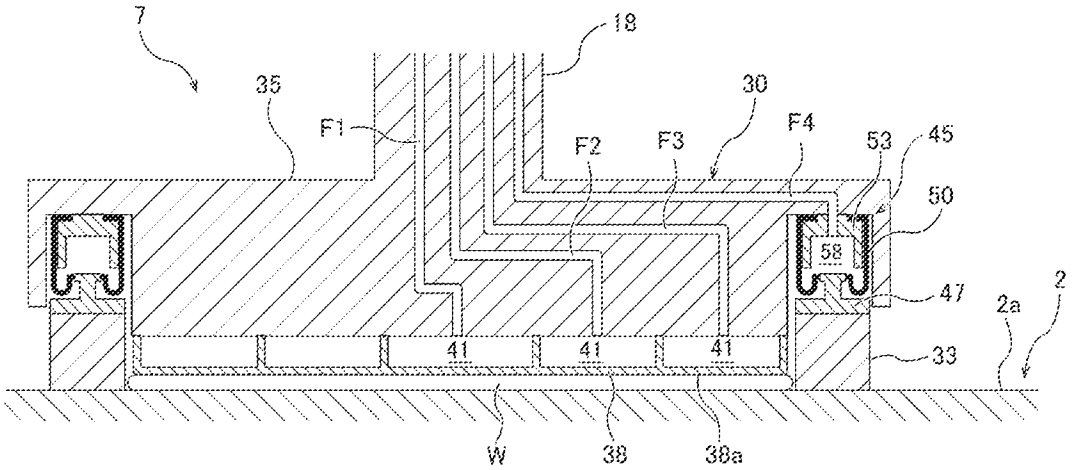
FIG. 2 is a cross-sectional view of a polishing head.

Next, details of the polishing head 7 will be described. FIG. 2 is a cross-sectional view of the polishing head 7. The polishing head 7 includes a head body 30 and a retainer ring 33. The head body 30 includes a carrier 35 coupled to the polishing-head shaft 18 and a first elastic membrane 38 attached to a lower surface of the carrier 35.

The first elastic membrane 38 has a lower surface constituting a pressing surface 38*a*, which is in contact with an upper surface of the workpiece W (i.e., a surface opposite to a surface to be polished). Through-holes (not shown) are formed in the first elastic membrane 38. First pressure chambers 41 are formed between the carrier 35 and the first elastic membrane 38. A central first pressure chamber 41 has a circular shape, and outer first pressure chambers 41 have annular shapes. These first pressure chambers 41 are coupled to a pressure regulator (not shown) through first fluid lines F1, F2, F3. When a pressurized fluid (for example, pressurized air) is supplied into the first pressure chambers 41, the pressing surface 38*a* of the first elastic membrane 38 that receives the fluid pressure in the first pressure chambers 41 presses the workpiece W against the polishing surface 2*a* of the polishing pad 2. When a negative pressure is formed in the first pressure chambers 41, the workpiece W is held on the pressing surface 38*a* of the first elastic membrane 38 by vacuum suction. The number of first pressure chambers 41 is not limited to the embodiment shown in FIG. 2. In one embodiment, a single first pressure chamber 41 may be provided between the carrier 35 and the first elastic membrane 38.

The retainer ring 33 is arranged so as to surround the workpiece W and the first elastic membrane 38. More specifically, the retainer ring 33 is arranged so as to surround the peripheral edge of the workpiece W and the pressing surface 38*a* of the first elastic membrane 38. An upper portion of the retainer ring 33 is coupled to an annular retainer-ring pressing mechanism 45. This retainer-ring pressing mechanism 45 is configured to apply a uniform downward load to the entire upper surface of the retainer ring 33 to thereby press a lower surface of the retainer ring 33 against the polishing surface 2*a* of the polishing pad 2.

The retainer-ring pressing mechanism 45 includes a coupling member 47 fixed to the upper portion of the retainer ring 33, an annular second elastic membrane 50 coupled to the coupling member 47, and an attachment member 53 configured to attach the second elastic membrane 50 to the carrier 35. Specific configurations of the coupling member 47 are not particularly limited, and the coupling member 47 may be an upper retainer ring. A second pressure chamber 58 is formed inside the second elastic membrane 50. The second pressure chamber 58 is coupled to the pressure regulator (not shown) through a second fluid line F4. The attachment member 53 is arranged in the second pressure chamber 58. The second fluid line F4 extends through the attachment member 53 and communicates with the second pressure chamber 58. In this embodiment, the attachment member 53 has an annular shape extending along the retainer ring 33.

When pressurized fluid (for example, pressurized air) is supplied into the second pressure chamber 58 through the second fluid line F4, the second elastic membrane 50 that receives the fluid pressure in the second pressure chamber 58 pushes the coupling member 47 downward, and the coupling member 47 in turn pushes the entire retainer ring 33 downward. In this way, the retainer-ring pressing mechanism 45 presses the lower surface of the retainer ring 33 against the polishing surface 2*a* of the polishing pad 2.

Figure 3:
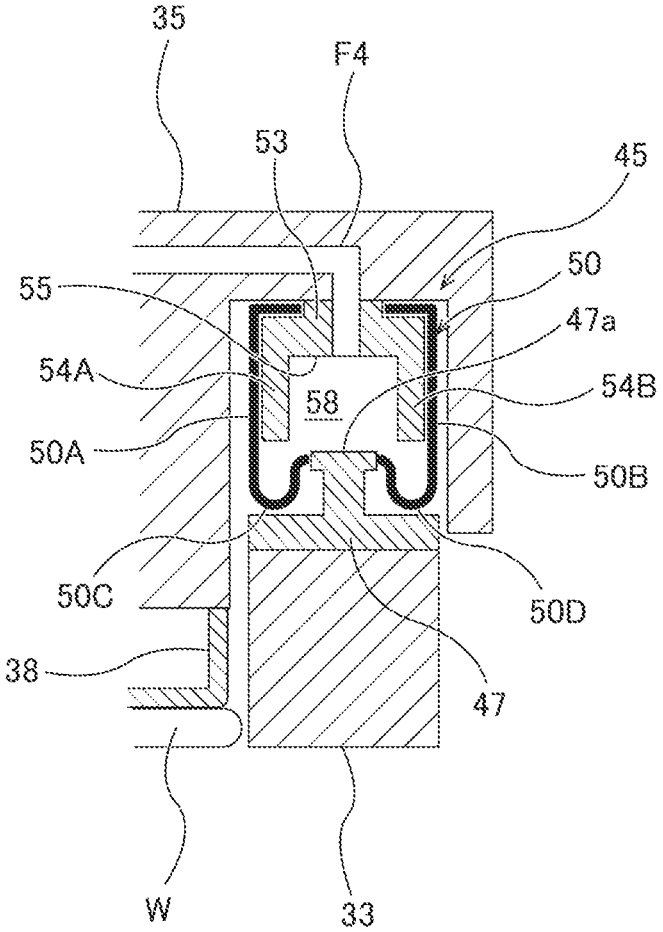
FIG. 3 is an enlarged cross-sectional view of a retainer ring and a retainer-ring pressing mechanism.

FIG. 3 is an enlarged cross-sectional view of the retainer ring 33 and the retainer-ring pressing mechanism 45. As shown in FIG. 3, the second elastic membrane 50 has two side walls 50A, 50B, a bottom wall 50C coupled to one side wall 50A, and a bottom wall 50D coupled to the other side wall 50B. The side wall 50A is located inwardly of the other side wall 50B, and the bottom wall 50C is located inwardly of the other bottom wall 50D. The upper end of the second elastic membrane 50, i.e., upper ends of the two side walls 50A, 50B, is fixed to the carrier 35 by the attachment member 53. The attachment member 53 is fixed to the carrier 35 by screws (not shown). The coupling member 47 is coupled to the two bottom walls 50C, 50D. The coupling member 47 is a movable member and moves up and down according to the pressure in the second pressure chamber 58. The coupling member 47 has a protruding portion 47*a* that protrudes toward the attachment member 53 (or protrudes upward).

The second elastic membrane 50 of the present embodiment is a rolling diaphragm having the two bottom walls 50C, 50D each having a downwardly curved cross section. The rolling-diaphragm type second elastic membrane 50 has an advantage that the second elastic membrane 50 can change its shape smoothly in response to the change in pressure in the second pressure chamber 58, without rubbing against the coupling member 47 and inner surfaces of the carrier 35. It is noted, however, that the second elastic membrane 50 is not limited to the shape of the present embodiment, and may be of a non-rolling diaphragm type having no downwardly curved bottom wall.

The attachment member 53 has two support portions 54A, 54B that protrude along the two side walls 50A, 50B toward the retainer ring 33. These support portions 54A, 54B extend downward and are located in the second pressure chamber 58. The support portions 54A, 54B are separated from each other, and a recessed portion 55 is formed between the support portions 54A, 54B. The recessed portion 55 of the present embodiment has an annular shape. The recessed portion 55 has a width larger than a width of the protruding portion 47*a* of the coupling member 47. Examples of material of the attachment member 53 include metal (for example, stainless steel), hard resin, ceramic, and the like.

Figure 4:
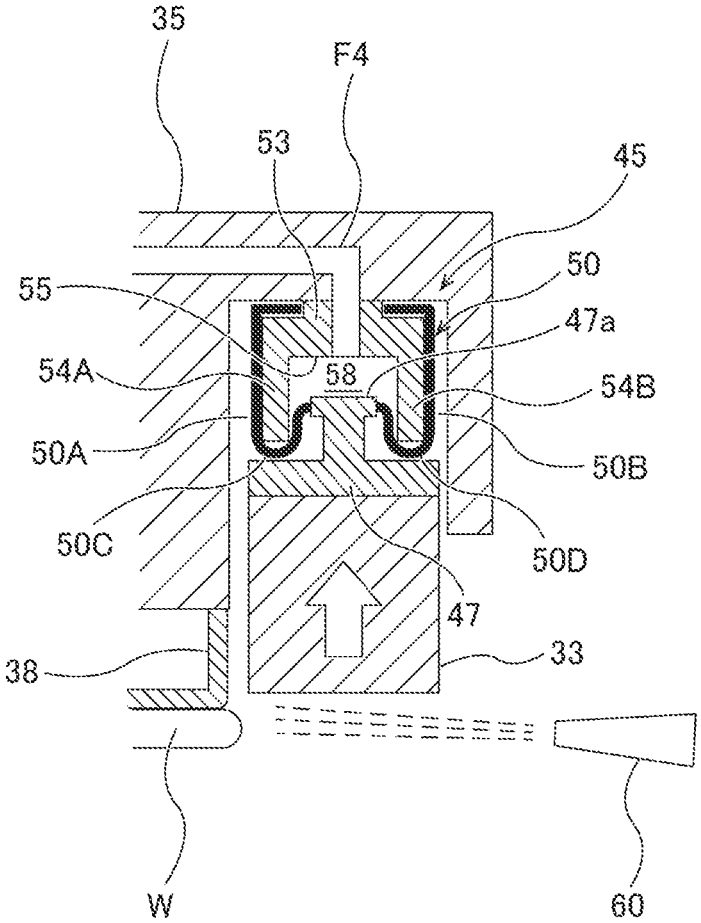
FIG. 4 is an enlarged cross-sectional view showing the retainer ring and the retainer-ring pressing mechanism when a negative pressure is formed in a second pressure chamber.

The support portions 54A, 54B extend along the inner surfaces of the two side walls 50A, SOB. When the pressurized fluid (for example, pressurized gas) is supplied into the second pressure chamber 58, the support portions 54A, 54B may contact the inner surfaces of the two side walls 50A, SOB, or may be out of contact with the inner surfaces of the two side walls 50A, SOB. The support portions 54A, 54B can support these side walls 50A, 50B from inside when a negative pressure is formed in the second pressure chamber 58. Specifically, as shown in FIG. 4, when a negative pressure is formed in the second pressure chamber 58, the side walls 50A, 50B are attracted to each other by the negative pressure, while inward movements of the side walls 50A, 50B are restricted by the support portions 54A, 54B. As a result, the support portions 54A, 54B can prevent the two side walls 50A, 50B from coming into contact with each other.

Further, according to the present embodiment, as shown in FIG. 4, when the negative pressure is formed in the second pressure chamber 58, the coupling member 47 moves (or rises) toward the attachment member 53, until the protruding portion 47*a* of the coupling member 47 is housed in the recessed portion 55 of the attachment member 53. At the same time, lower parts of the support portions 54A, 54B are housed in the downwardly curved bottom walls 50C, 50D, respectively. Therefore, a large stroke (i.e., a long moving distance) of the coupling member 47 and the retainer ring 33 is ensured. The retainer ring 33 can be raised to a position higher than a contact portion between the first elastic membrane 38 and the workpiece W. Therefore, the release nozzle 60 can release the workpiece W from the first elastic membrane 38 by emitting a jet of liquid (for example, pure water) to the contact portion between the first elastic membrane 38 and the workpiece W. Further, since the support portions 54A, 54B can prevent the side walls 50A, 50B of the second elastic membrane 50 from being largely deformed, the life of the second elastic membrane 50 can be extended.

Figure 5:
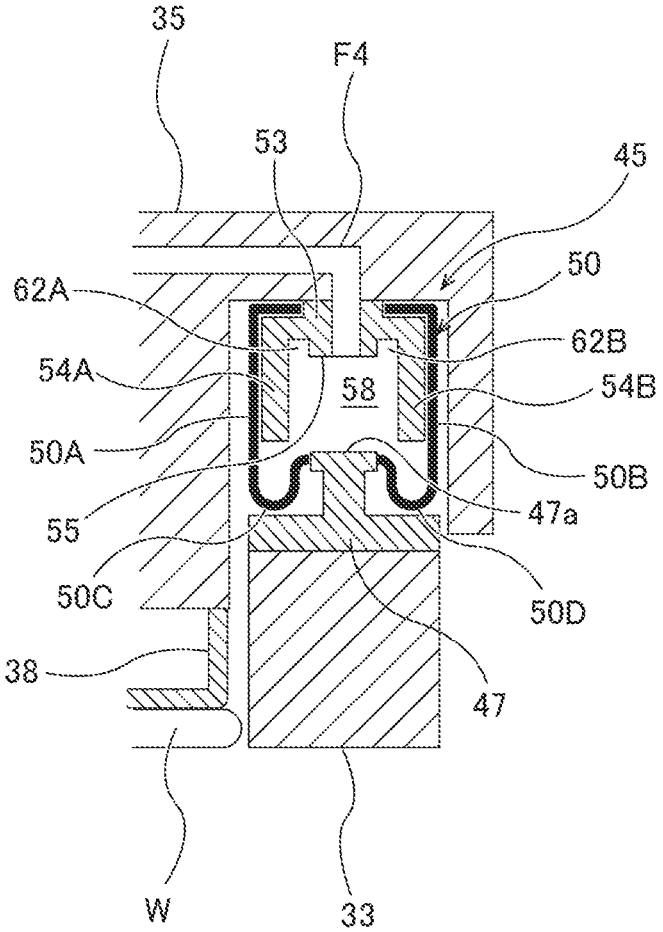
FIG. 5 is an enlarged cross-sectional view showing another embodiment of an attachment member.

FIG. 5 is an enlarged cross-sectional view showing another embodiment of the attachment member 53. Configurations of the present embodiment, which will be not particularly described, are the same as those of the embodiments described with reference to FIGS. 1 to 4, and duplicate descriptions thereof will be omitted. As shown in FIG. 5, the attachment member 53 has grooves 62A, 62B extending in the circumferential direction of the second elastic membrane 50 along the support portions 54A, 54B. In the present embodiment, the two annular grooves 62A, 62B extend along the insides of the two support portions 54A, 54B. These grooves 62A, 62B allow for quick formation of the negative pressure in the entire annular second pressure chamber 58 when the gas in the second pressure chamber 58 is evacuated through the second fluid line F4. Therefore, the entire retainer ring 33 can be raised smoothly and quickly.

Figure 6:
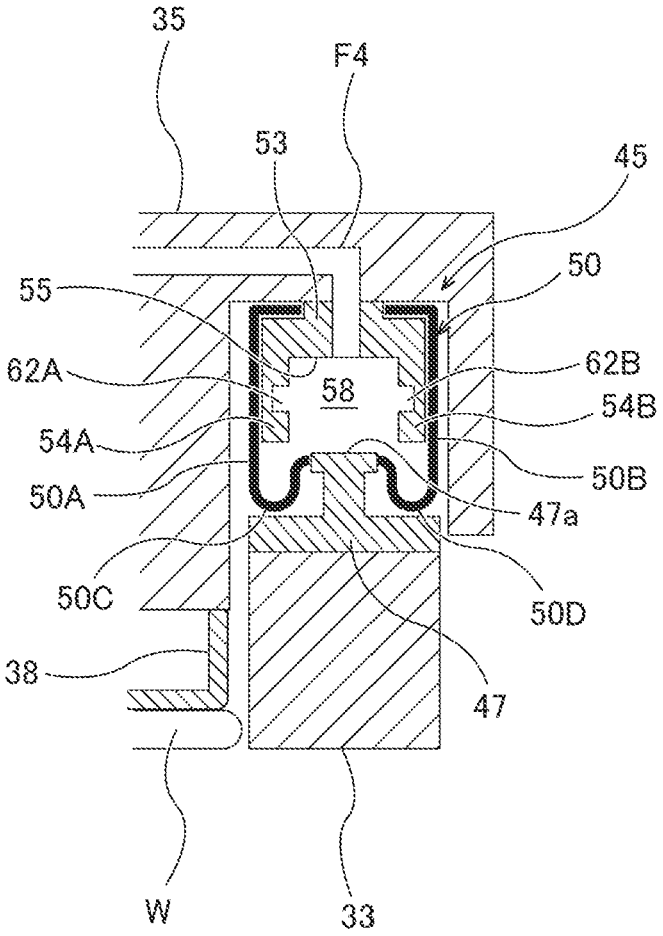
FIG. 6 is an enlarged cross-sectional view showing still another embodiment of the attachment member.

In the embodiment shown in FIG. 5, the grooves 62A, 62B are formed along the upper ends of the support portions 54A, 54B. However, the positions of the grooves 62A, 62B are not limited to the embodiment shown in FIG. 5. For example, as shown in FIG. 6, the grooves 62A, 62B may be located between the upper ends and the lower ends of the support portions 54A, 54B.

Figure 7:
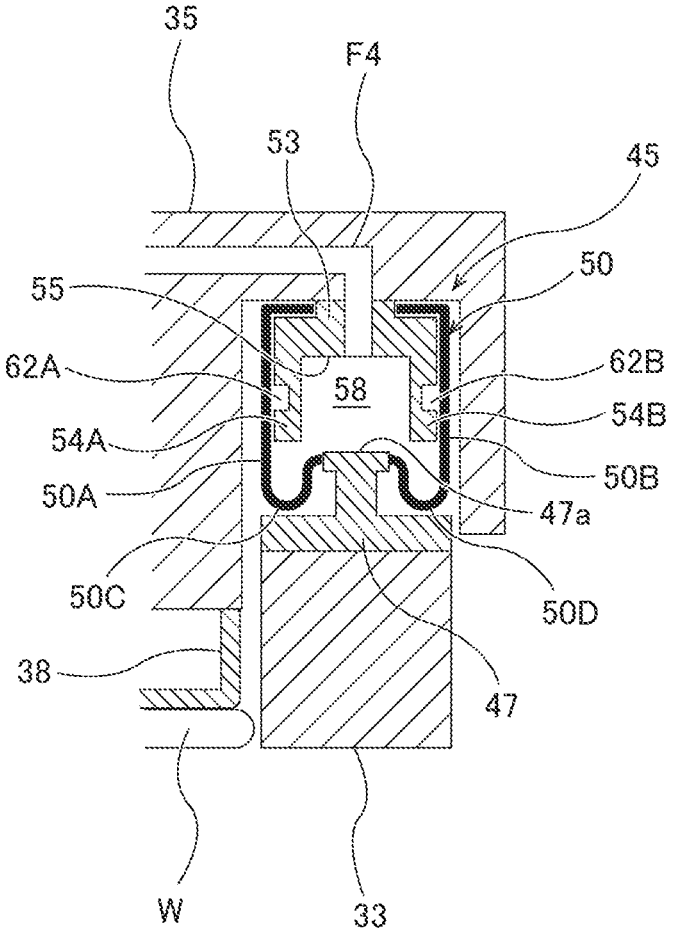
FIG. 7 is an enlarged cross-sectional view showing still another embodiment of the attachment member.

In one embodiment, as shown in FIG. 7, the grooves 62A, 62B may be formed in outer sides (or outer surfaces) of the support portions 54A, 54B. In this embodiment shown in FIG. 7, the two annular grooves 62A, 62B extend along the outsides of the two support portions 54A, 54B. When a pressurized fluid (for example, pressurized air) is supplied into the second pressure chamber 58, the pressurized fluid flows into the grooves 62A, 62B and acts on the side walls 50A, 50B of the second elastic membrane 50 so as to separate the side walls 50A, 50B from the support portions 54A, 54B. As a result, the second elastic membrane 50 can be smoothly deformed in response to the pressure in the second pressure chamber 58, and the retainer ring 33 can be smoothly moved. In one embodiment, the attachment member 53 may have both the grooves (first grooves) 62A, 62B shown in FIG. 5 or 6, and the grooves (second grooves) 62A, 62B shown in FIG. 7.

Figure 8:
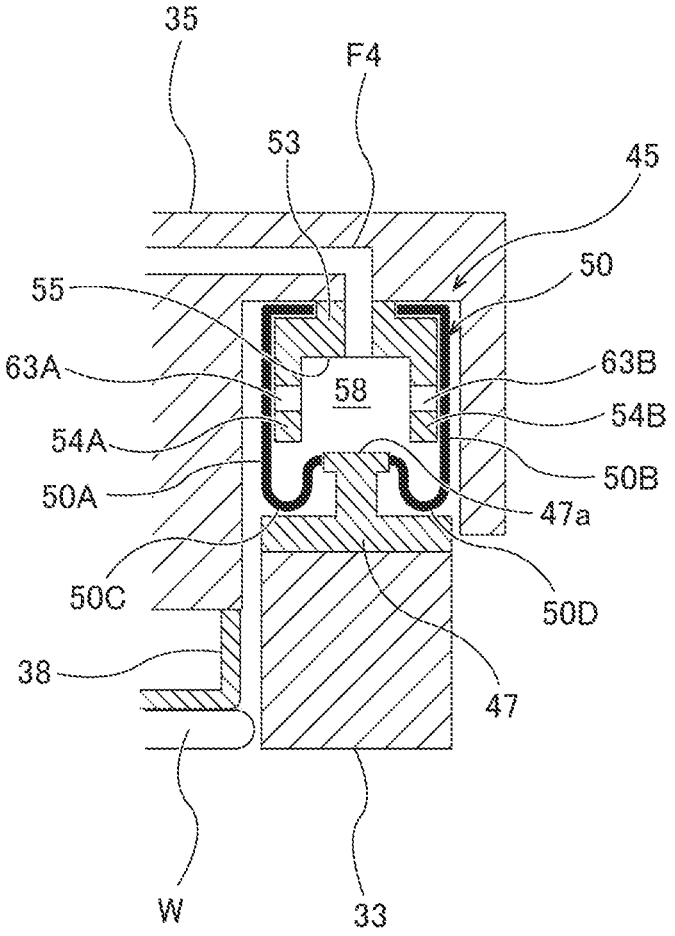
FIG. 8 is an enlarged cross-sectional view showing still another embodiment of the attachment member.
Figure 9:
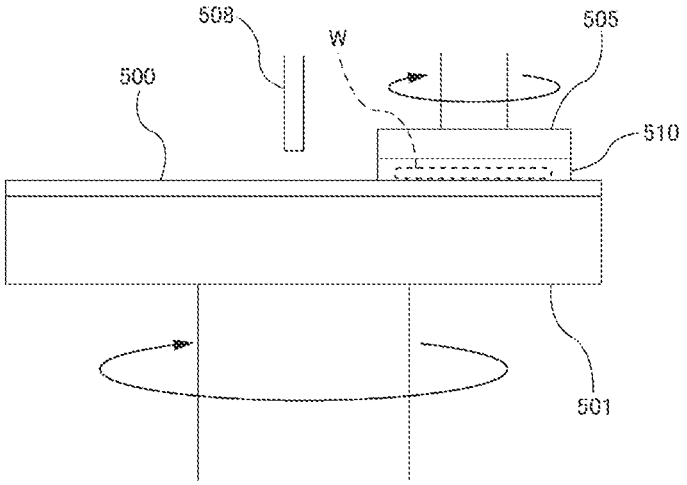
FIG. 9 is a schematic view showing a conventional polishing apparatus.
Figure 10:
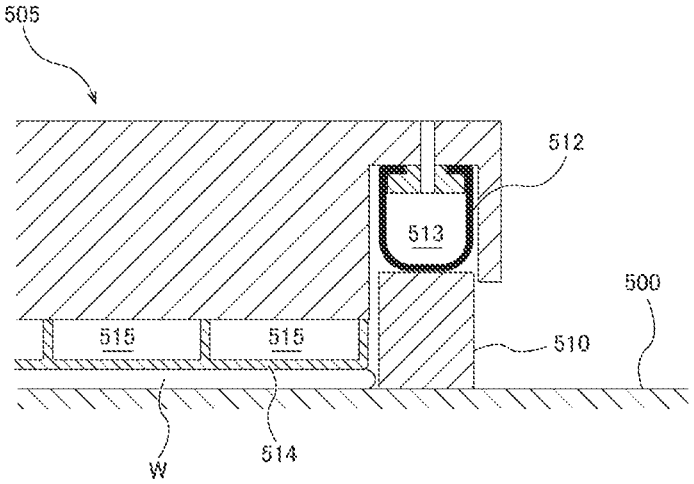
FIG. 10 is a cross-sectional view showing a part of a polishing head shown in FIG. 9.
Figure 11A:
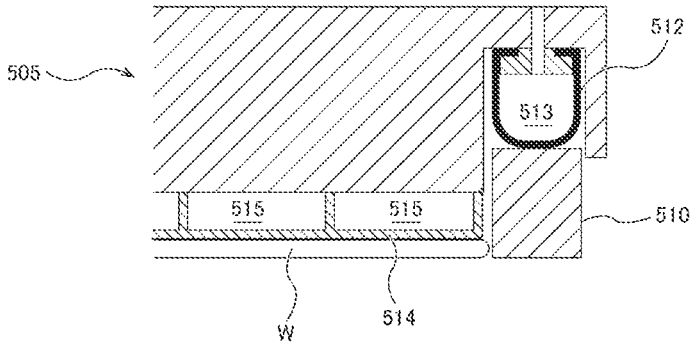
FIGS. 11A to 11C are diagrams for explaining operations of the conventional polishing head.
Figure 11B:
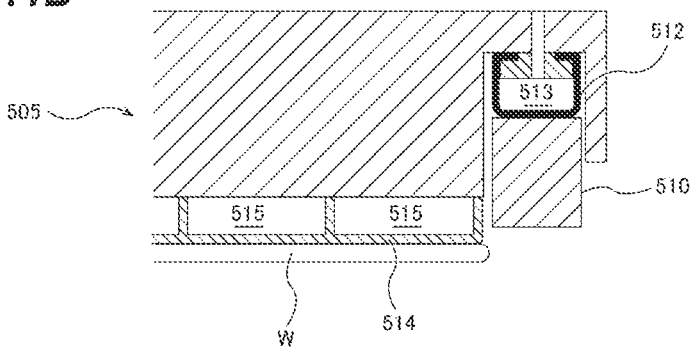
Figure 11C:
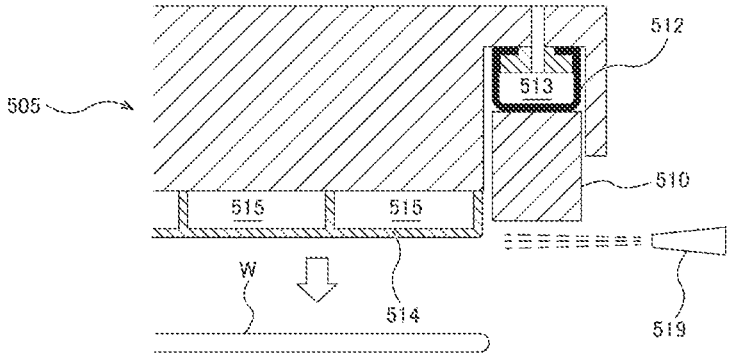
Figure 12:
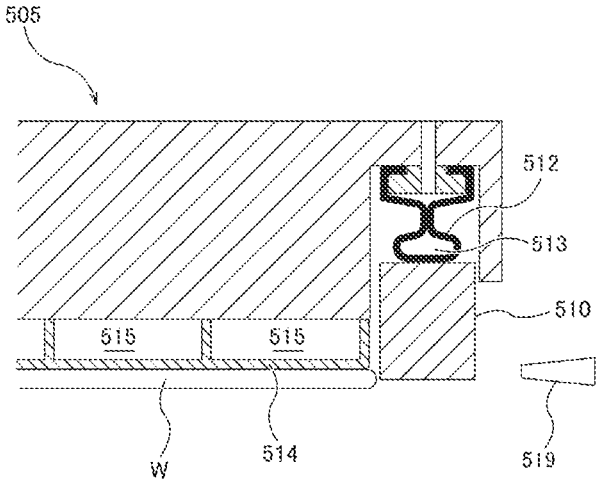
FIG. 12 is a diagram for explaining problems of the conventional polishing head.

FIG. 8 is an enlarged cross-sectional view showing another embodiment of the attachment member 53. Configurations of the present embodiment, which will be not particularly described, are the same as those of the embodiments described with reference to FIGS. 1 to 4, and duplicate descriptions thereof will be omitted. As shown in FIG. 8, the attachment member 53 has a plurality of through-holes 63A, 63B extending through the support portions 54A, 54B. In FIG. 8, although only one through-hole 63A formed in the support portion 54A and only one through-hole 63B formed in the support portion 54B are depicted, the plurality of through-holes 63A, 63B are arranged along the circumferential direction of the second elastic membrane 50. The through-holes 63A, 63B extend through the support portions 54A, 54B in radial directions of the second elastic membrane 50.

As with the embodiment described with reference to FIG. 7, when the pressurized fluid (for example, pressurized air) is supplied into the second pressure chamber 58, the pressurized fluid flows into the plurality of through-holes 63A, 63B and acts on the side walls 50A, 50B of the second elastic membrane 50 so as to separate the side walls 50A, 50B from the support portions 54A, 54B. As a result, the second elastic membrane 50 can be smoothly deformed in response to the pressure in the second pressure chamber 58, and the retainer ring 33 can be smoothly moved. In one embodiment, the attachment member 53 may have both the grooves 62A, 62B shown in FIG. 5 or 6, and the plurality of through-holes 63A, 63B shown in FIG. 8.

In each of the embodiments shown in FIGS. 2 to 8, at least the outer surfaces of the support portions 54A, 54B may have been subjected to friction reduction treatment. The friction reduction treatment is a treatment capable of reducing the friction between the support portions 54A, 54B and the second elastic membrane 50. Examples of the friction reduction treatment include coating of the support portions 54A, 54B with fluororesin (for example, polytetrafluoroethylene) and roughening of the surfaces of the support portions 54A, 54B (for example, blast process or embossing).

The support portions 54A, 54B that have been subjected to the friction reduction treatment enable the second elastic membrane 50 to be smoothly deformed in response to the pressure in the second pressure chamber 58. As a result, the retainer ring 33 can be moved smoothly.

The previous description of embodiments is provided to enable a person skilled in the art to make and use the present invention. Moreover, various modifications to these embodiments will be readily apparent to those skilled in the art, and the generic principles and specific examples defined herein may be applied to other embodiments. Therefore, the present invention is not intended to be limited to the embodiments described herein but is to be accorded the widest scope as defined by limitation of the claims.

What is claimed is:

1. A polishing head for pressing a workpiece against a polishing pad to polish the workpiece, comprising:
- a first elastic membrane configured to press the workpiece against the polishing pad;
- a retainer ring surrounding the first elastic membrane;
- a second elastic membrane configured to press the retainer ring against the polishing pad;
- a carrier to which the first elastic membrane is secured;
- an attachment member arranged in a pressure chamber formed by the second elastic membrane and fixing the second elastic membrane to the carrier; and
- a coupling member configured to couple the second elastic membrane to the retainer ring,
- the second elastic membrane including:
  - a bottom wall coupled to the coupling member; and
  - a side wall coupled to the bottom wall, the attachment member having a support portion extending toward the retainer ring along the side wall,
- wherein the attachment member has a groove extending along the support portion in a circumferential direction of the second elastic membrane.

2. The polishing head according to claim 1, wherein:
- the side wall comprises a first side wall and a second side wall separated from each other;
- the support portion comprises two support portions extending along the first side wall and the second side wall, respectively;
- the attachment member has a recessed portion located between the two support portions; and
- the coupling member has a protruding portion which is housed in the recessed portion when the coupling member moves toward the attachment member.

3. The polishing head according to claim 1, wherein:
- the bottom wall has a cross-sectional shape curved toward the retainer ring; and
- at least a part of the support portion is housed in the curved bottom wall when the coupling member moves toward the attachment member.

4. The polishing head according to claim 1, wherein at least an outer surface of the support portion has been subjected to a friction reduction treatment.

5. A polishing apparatus comprising:
- a polishing table configured to support a polishing pad; and
- the polishing head according to claim 1 for pressing the workpiece against the polishing pad to polish the workpiece.

6. A polishing head for pressing a workpiece against a polishing pad to polish the workpiece, comprising:

a first elastic membrane configured to press the workpiece against the polishing pad;

a retainer ring surrounding the first elastic membrane;

a second elastic membrane configured to press the retainer ring against the polishing pad;

a carrier to which the first elastic membrane is secured;

an attachment member arranged in a pressure chamber formed by the second elastic membrane and fixing the second elastic membrane to the carrier; and a coupling member configured to couple the second elastic membrane to the retainer ring, the second elastic membrane including:

a bottom wall coupled to the coupling member; and a side wall coupled to the bottom wall, the attachment member having a support portion extending toward the retainer ring along the side wall, wherein the attachment member has through-holes extending through the support portion, and the through-holes are arranged along a circumferential direction of the second elastic membrane.

7. The polishing head according to claim 6, wherein:

the side wall comprises a first side wall and a second side wall separated from each other;

the support portion comprises two support portions extending along the first side wall and the second side wall, respectively;

the attachment member has a recessed portion located between the two support portions; and the coupling member has a protruding portion which is housed in the recessed portion when the coupling member moves toward the attachment member.

8. The polishing head according to claim 6, wherein:

the bottom wall has a cross-sectional shape curved toward the retainer ring; and at least a part of the support portion is housed in the curved bottom wall when the coupling member moves toward the attachment member.

9. The polishing head according to claim 6, wherein at least an outer surface of the support portion has been subjected to a friction reduction treatment.

10. A polishing apparatus comprising:

a polishing table configured to support a polishing pad; and the polishing head according to claim 6 for pressing the workpiece against the polishing pad to polish the workpiece.

* * * * *